US007465256B2

(12) United States Patent
Mäenpää

(10) Patent No.: US 7,465,256 B2
(45) Date of Patent: Dec. 16, 2008

(54) TREADMILL ARRANGEMENT

(75) Inventor: Simo Mäenpää, Turku (FI)

(73) Assignee: Tunturi Oy, Ltd., Turku (FI)

( * ) Notice: Subject to any disclaimer, the term of this patent is extended or adjusted under 35 U.S.C. 154(b) by 0 days.

(21) Appl. No.: 09/894,803

(22) Filed: Jun. 29, 2001

(65) Prior Publication Data

US 2003/0004035 A1 Jan. 2, 2003

(30) Foreign Application Priority Data

Jul. 7, 2000 (FI) ..... 20001624

(51) Int. Cl.
*A63B 22/02* (2006.01)
*A63B 71/00* (2006.01)

(52) U.S. Cl. ..... 482/54; 482/8

(58) Field of Classification Search ..... 482/51–54, 482/1–9

See application file for complete search history.

(56) References Cited

U.S. PATENT DOCUMENTS

| | | | | |
|---|---|---|---|---|
| 1,919,627 | A * | 7/1933 | Fitzgerald | |
| 3,518,985 | A | 7/1970 | Quinton | |
| 4,708,337 | A * | 11/1987 | Shyu | 482/54 |
| 5,314,391 | A | 5/1994 | Potash et al. | |
| 5,527,239 | A | 6/1996 | Abbondanza | |
| 5,690,587 | A * | 11/1997 | Gruenangerl | 482/54 |
| 5,800,314 | A * | 9/1998 | Sakakibara et al. | 482/54 |
| 5,879,270 | A * | 3/1999 | Huish et al. | 482/54 |
| 5,921,893 | A * | 7/1999 | Hurt | 482/54 |
| 6,033,344 | A * | 3/2000 | Trulaske et al. | 482/54 |

FOREIGN PATENT DOCUMENTS

| | | |
|---|---|---|
| DE | 19821 453 C1 | 1/2000 |
| EP | 0 441 104 A1 | 8/1991 |
| WO | WO 97/34663 | 9/1997 |
| WO | WO 98/36400 | 8/1998 |
| WO | WO 98/42413 | 10/1998 |

* cited by examiner

*Primary Examiner*—Steve R Crow
(74) *Attorney, Agent, or Firm*—Black Lowe & Graham PLLC; H. Albert Richardson

(57) ABSTRACT

A treadmill arrangement, which comprises a treadmill and also a transmitter (31) that is arranged to be connectable to a treadmill user and to transmit an electromagnetic signal (30), at least one receiver (32) that is arranged in connection with the treadmill to receive the signal transmitted by the transmitter (31), apparatus for processing (33) the signal, and apparatus for generating (34) information that is arranged to receive the information arriving from the signal processing apparatus (33) and to generate therefrom the user's position data (39) and/or control information (38). To provide accurate operation, the transmitter (31) transmitting the electromagnetic signal (30) is a transmitter part of a heart rate monitor or a heart rate measuring system.

10 Claims, 3 Drawing Sheets

TREADMILL ARRANGEMENT

The invention relates to a treadmill arrangement, which comprises a treadmill and also a transmitter that is arranged to be connectable to a treadmill user and to transmit an electromagnetic signal, at least one receiver that is arranged in connection with the treadmill to receive the signal transmitted by the transmitter, an apparatus for processing the signal, and an apparatus for generating information that is arranged to receive the information arriving from the signal processing apparatus and to generate therefrom the user's position data and/or control information. The description of the invention focuses on a motorized treadmill intended for exercise, but the invention is also applicable to other devices operating on a corresponding principle. In this context, the term treadmill is considered to cover more broadly devices with a moving pacing surface intended for both humans and animals, such as a walking platform. The treadmill arrangement comprises a treadmill and the related peripherals, such as a computer.

Typical treadmills consist of a motorized running belt mounted on a frame, the rotation speed and gradient of the running belt being adjustable according to the user's needs. The adjustment of these parameters is typically implemented on a manual or software basis. Manual adjustment is problematic, in particular, during use, because it interferes with the user's performance or requires that an assistant be used. Adjustment by means of software is typically implemented by a plurality of preselective programs that adjust the parameters of the treadmill as a function of time. The adjustment by means of software does not require any measures of the user during the performance, but it does not necessarily react either to the user's performance on the treadmill, with the exception of information obtained from a heart rate monitor, by which information the treadmill can be adjusted during the user's performance.

More interactive adjustment would be provided if the control could utilize e.g. user location data on the treadmill, in addition to the heart rate information. By means of the position, the treadmill parameters could be adjusted to comply with the user's performance. For instance, if the user continuously moves to the end portion of the treadmill, it may indicate that the user is getting tired, and the rotation speed of the treadmill should be reduced. In addition to the treadmill itself, the position data also allow to control the parameters of the peripherals, such as a computer, game console, mobile telephone, communicator, etc. The use of these peripherals will probably increase in the future, when new applications, such as virtual and game world, are desired around the treadmill.

Some systems that are comparable to fixing the location data of the user are known in connection with treadmills. Rough location fixing of the user is implemented, for instance, with a photoelectric cell system, in which light sources disposed at predetermined points and the counterparts thereof detect the user's leg that has moved into the path of a light beam. FIG. 1 shows this location and its representation as a function of time. A drawback with this system is that the method is discrete; the photoelectric cell system only allows to detect the user's position at given points depending on the disposition of the light sources. The location method is thus not sufficient for more advanced control applications, for instance for being connected to the virtual world, which requires a continuous flow of position information. By disposing a plurality of light sources the position accuracy increases to some extent, but it makes the system heavier and the apparatus more expensive. A system has also been developed (by Dr. G. Coen, E. Luhn, D. Oberhoff, Düsseldorf, Germany), in which the definition of the user's distance from the front edge of the treadmill is carried out by utilizing the phase differences of sound reflection, but this arrangement also requires expensive additional apparatuses to the existing treadmill arrangement.

The object of the invention is thus to provide an arrangement such that the treadmill and the related peripherals can be controlled by utilizing continuous location data on the user. The arrangement is to be simply and economically implemented by utilizing devices that are previously attached to the treadmill. This is achieved by the arrangement according to the invention. The treadmill arrangement of the invention is characterized in that a transmitter transmitting an electromagnetic signal is a transmitter part of a heart rate monitor or a heart rate measuring system.

The invention is based on the idea that the treadmill arrangement is partly controlled on the basis of the position of the treadmill user, and the particular position data is generated from the electromagnetic signal transmitted by a device connected to the user.

An advantage with the arrangement of the invention is active reaction to the user's performance, accurate and continuous location of the user, simple implementation and applicability to future interactive solutions. The system can utilize existing accessories, such as a heart rate monitor, attached to the treadmill, whereby cost savings are achieved and new applications are provided for known devices.

In the following, the invention will be described in greater detail, with reference to the attached drawings, wherein FIG. 1 illustrates known, discrete location, provided by photoelectric cells, as a function of time;

Figure 1:
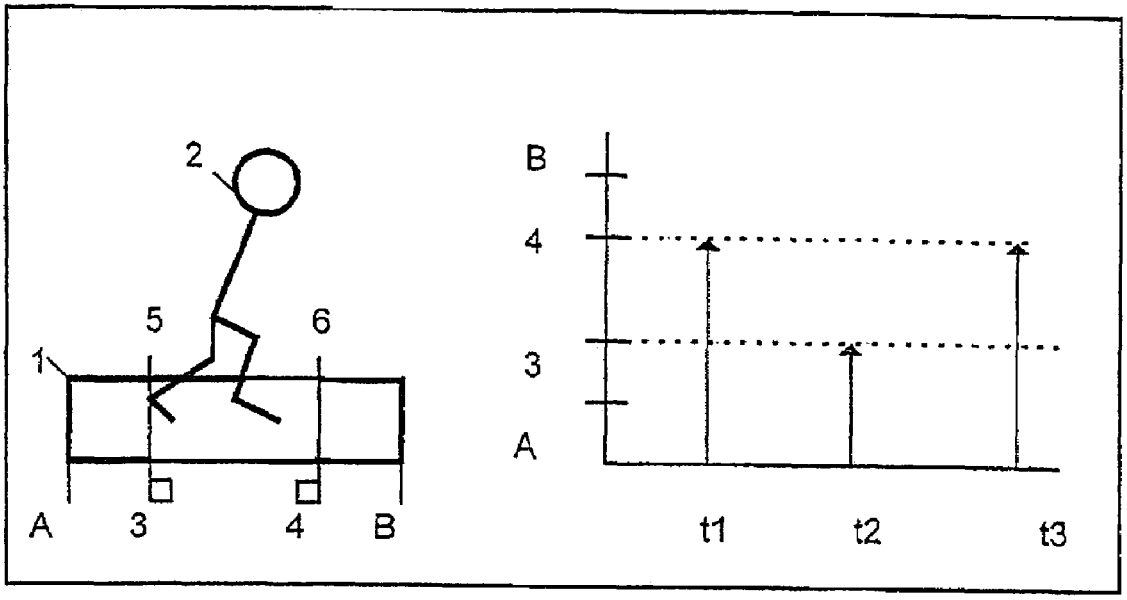
Figure 1. PRIOR ART

FIG. 1 illustrating the prior art shows a treadmill 1 and a user 2 as well as light sources 3 and 4 disposed a the edges of the treadmill. The light sources are disposed such that their counterparts 5 and 6 detect obstacles entering the path of a light beam. It appears from the figure that the position data on the runner is only available at time instants $t_{1,2,3}$, when the runner hits the path of the light beam. If the light sources are not arranged at short intervals at the edges of the treadmill, it is not possible to know in which direction the runner moves next from the light beam that hit him/her. The figure only shows the system locating the longitudinal motion on the treadmill.

Figure 2:
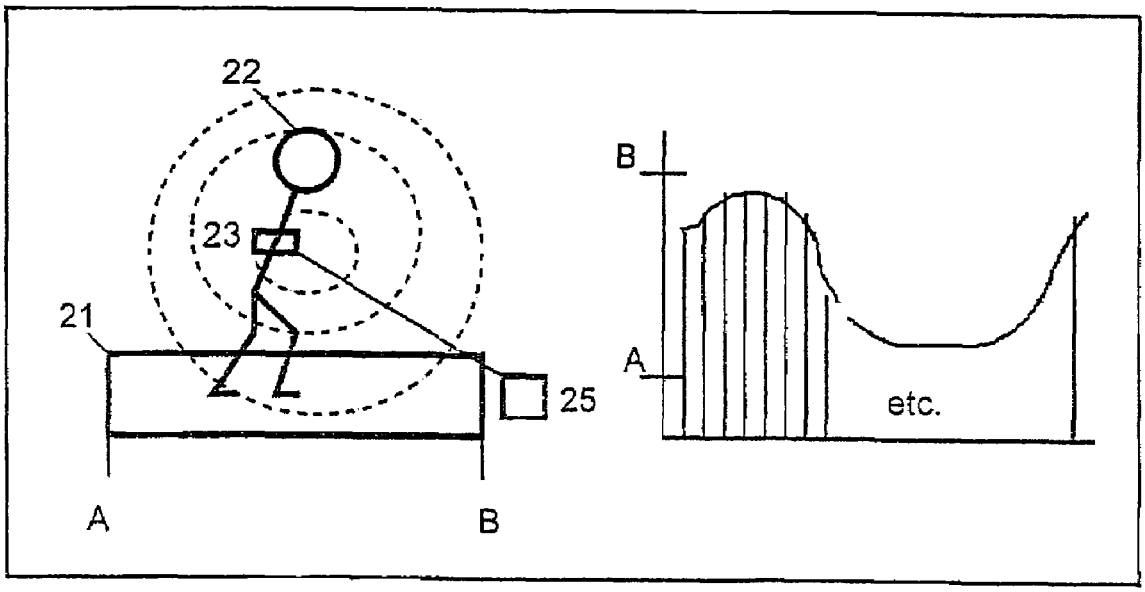
FIG. 2 illustrates continuous location, generated by an electromagnetic field, of the arrangement according to the invention, as a function of time.

FIG. 2 shows a location method of the treadmill arrangement of the invention, in which a signal source 23 generating an electromagnetic field is disposed on the runner 22 and a signal receiving device 25 is disposed in connection with the treadmill. On the basis of the strength of the received signal, i.e. in practice on the basis of the field intensity, it is possible to define the distance between the transmitter and the receiver in a known manner. When the receiver is disposed at the end of the treadmill, the user's motion in the longitudinal direction of the treadmill can be detected. If particularly accurate location is required, the treadmill can be provided with a plurality of signal receivers, whereby field intensities measured by different receivers are taken into account. The receivers can be disposed on divergent sides of the treadmill, whereby it is possible to react to both longitudinal and transversal motions of the mat. Both receivers may also be located on the parallel sides or on one side of the treadmill, whereby they preferably have to be clearly apart from one another (20 to 120 cm). Various dispositions of the receivers permit that the main focus is on the direction of motion that is the most essential in each particular application.

Figure 3:
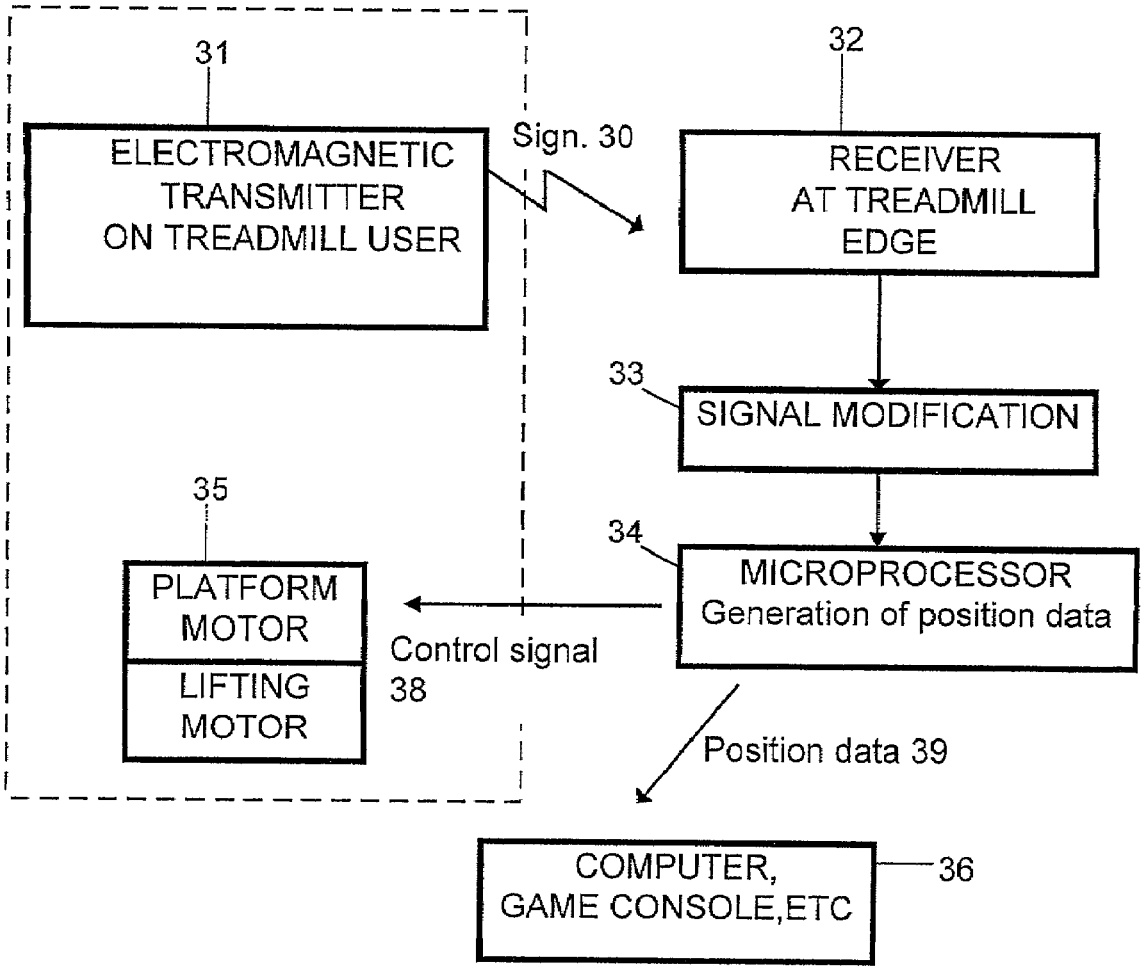
FIG. 3 illustrates the principle of the arrangement according to the invention.

FIG. 3 is a block diagram of the principle of the arrangement according to the invention. A transmitter 31 connected to the runner transmits a signal 30 as an electromagnetic field to a receiver 32. The signal is modified 33 and conveyed to a microprocessor 34, which generates position data 39 and/or control information 38 on the basis of the distance information obtained by the intensity of the field.

Figure 4:
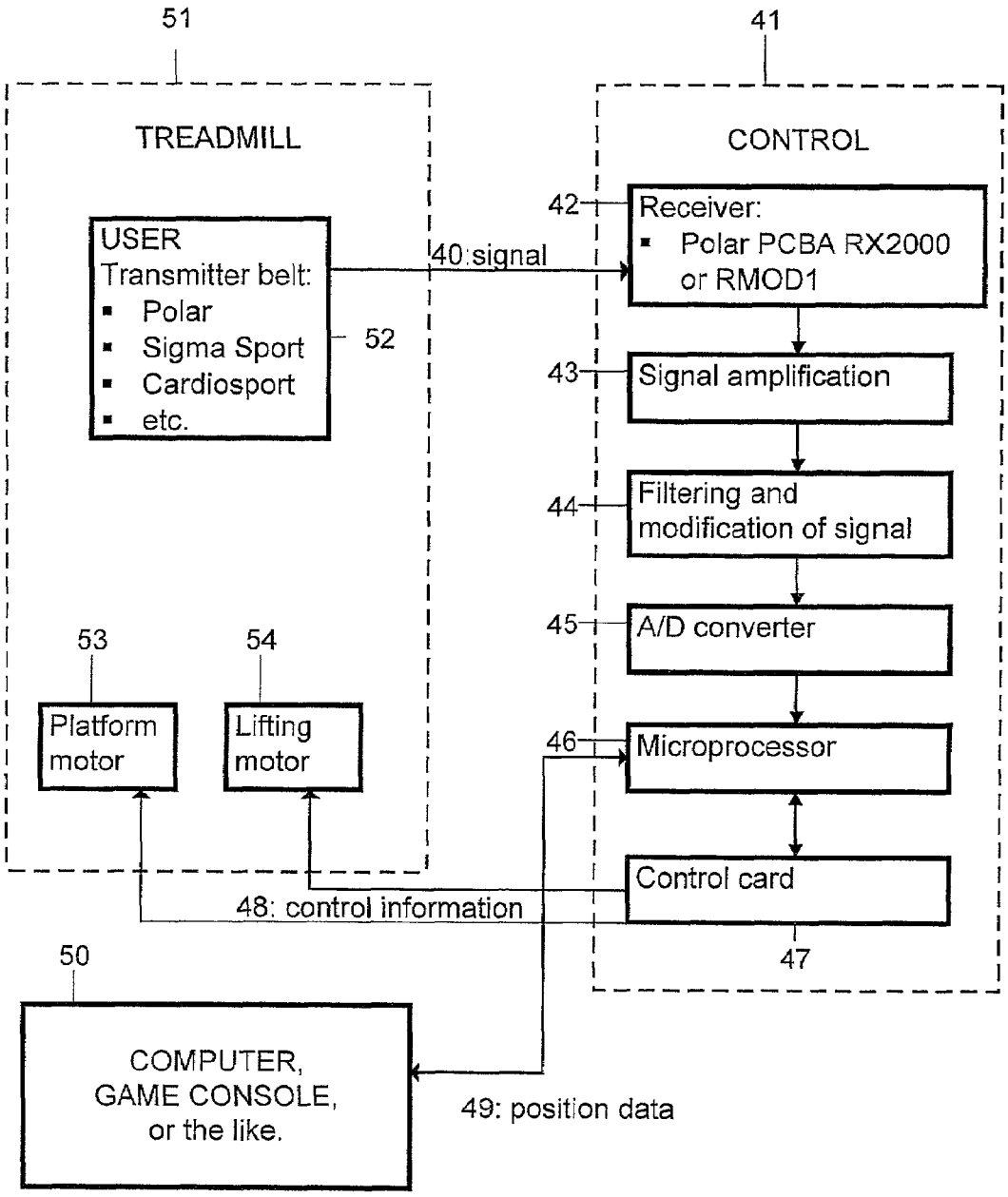
FIG. 4 illustrates one preferred embodiment of the arrangement according to the invention.

FIG. 4 shows one preferred embodiment of the arrangement according to the invention, where a heart rate monitor is used as a transmitter and a receiver. In the figure, the runner on the treadmill 51 wears a belt of the heart rate monitor, which serves as a transmitter 52 of a signal 40. The heart rate monitor used can be that of the brand names Polar, Sigma Sport or Cardiosport, for instance, and the transmission frequency of the signal 40 can be 5 kHz +/−10%, for instance. A receiver 42 that is fixedly attached to the treadmill, in this case the receiver part of the heart rate monitor Polar PCBA RX2000 or RMoD1, receives the signal 40. The strength data of the received signal 40 is read at the receiver measurement point or directly from the receiver coil. On the basis of this strength data it is possible to define the distance between the transmitter and the receiver in a known manner. In signal processing, the signal is amplified at an amplifier 43, filtered at a filter 44 and converted from an analog to a digital signal at the Analog to Digital Converter 45. From the distance obtained on the basis of the strength of the signal 40, the microprocessor 46 further determines position data 49 that is conveyed to a computer or a game console 50, and/or modifies the control information 48 to be conveyed to the treadmill control. The treadmill control may comprise the adjustment of the rotation speed of the platform by means of a treadmill motor 53 or the adjustment of the gradient by means of a lifting motor 54. The pulse rate information of the exercising person may simultaneously be included in the described system.

It is obvious to the person skilled in the art that as technology advances, the basic idea of the invention can be implemented in a variety of ways. Thus, the invention and its embodiments are not restricted to the above-described examples but they may vary within the scope of the claims.

The invention claimed is:

1. A treadmill apparatus including a motorized endless belt adjustable in slope, the apparatus comprising:

means for receiving an electromagnetic signal, the receiving means having a predetermined operating range;

means attachable to a treadmill user for generating an electromagnetic signal having a field strength variable within the operating range;

means for detecting the field strength and for producing a control signal responsive to the field strength; and an apparatus attached to the treadmill apparatus and responsive to the control signal for adjusting the slope of the endless belt.

2. The apparatus of claim 1 wherein the belt is adjustable in rotational speed and includes an apparatus for adjusting the speed of the belt.

3. A treadmill apparatus including a motorized endless belt adjustable in slope and rotational speed, the apparatus comprising:

a receiver for receiving an electromagnetic signal, the receiver having a predetermined operating range;

a transmitter attachable to a user for generating an electromagnetic signal having a field strength variable within the operating range;

means for detecting the field strength and for producing a control signal responsive to the field strength, the means including at least one amplifier, at least one filter, at least one signal modifier and at least one microprocessor; and an apparatus attached to the treadmill apparatus and responsive to the control signal for adjusting the slope and rotational speed of the slope and endless belt.

4. The apparatus of claim 3 wherein the transmitter includes a transmitter portion of a heart rate monitor.

5. The apparatus of claim 3 wherein the apparatus for adjusting includes a lifting motor.

6. The apparatus of claim 3 including a heart rate monitor having a receiver portion and wherein the receiver is the receiver portion of heart rate monitor.

7. A treadmill apparatus including an adjustable motorized endless belt, the apparatus comprising:

a receiver for receiving an electromagnetic signal, the receiver having a predetermined operating range;

a transmitter attachable to a user for generating an electromagnetic signal having a field strength variable within the operating range;

a signal processor for detecting the field strength and for producing a control signal responsive to the field strength, the processor including at least one amplifier, at least one filter, at least one signal modifier and at least one microprocessor;

a lifting motor attached to the treadmill apparatus and responsive to the control signal for adjusting the endless belt; and a treadmill motor attached to the treadmill apparatus and responsive to the control signal for adjusting the rotational speed of the endless belt.

8. The apparatus of claim 7 wherein the transmitter includes a transmitter portion of a heart rate monitor.

9. The apparatus of claim 7 wherein the receiver is the receiver portion of heart rate monitor.

10. A treadmill apparatus including a motorized endless belt adjustable in rotational speed, the apparatus comprising:

means for receiving an electromagnetic signal, the receiving means having a predetermined operating range;

means attachable to a treadmill user for generating an electromagnetic signal having a field strength variable within the operating range;

means for detecting the field strength and for producing a control signal responsive to the field strength; and an apparatus attached to the treadmill apparatus and responsive to the control signal for adjusting the rotational speed of the endless belt.

* * * * *